United States Patent [19]

Bäuerle et al.

[11] 4,101,192

[45] Jul. 18, 1978

[54] ELECTRICAL CONNECTOR WITH RELEASABLE CONTACT MEMBERS

[75] Inventors: Gerhard Bäuerle Willsbach; Oswald Hübuer, Neuenstadt, both of Germany

[73] Assignee: Bunker Ramo Corporation, Oak Brook, Ill.

[21] Appl. No.: 773,668

[22] Filed: Mar. 2, 1977

Related U.S. Application Data

[63] Continuation of Ser. No. 631,282, Nov. 12, 1975, abandoned.

[30] Foreign Application Priority Data

Nov. 15, 1974 [DE] Fed. Rep. of Germany ..... 2454317

[51] Int. Cl.[2] ..... H01R 9/16

[52] U.S. Cl. ..... 339/217 S

[58] Field of Search ..... 339/217 S

[56] References Cited

U.S. PATENT DOCUMENTS

| | | | |
|---|---|---|---|
| 3,566,342 | 2/1971 | Schmitt | 339/217 S |
| 3,601,775 | 8/1971 | Longenecker | 339/217 S |
| 3,808,589 | 4/1974 | Bonhomme | 339/217 S |

*Primary Examiner*—Roy Lake
*Assistant Examiner*—E. F. Desmond
*Attorney, Agent, or Firm*—Hill, Gross, Simpson, Van Santen, Steadman, Chiara & Simpson

[57] ABSTRACT

An electrical connector with releasable contact members is disclosed in which the electrical connector comprises an insulating body with at least one contact receiving chamber open on opposite faces and a contact member disposed inside the contact chamber. The contact member is provided with a locking tab with which the contact member can be locked into position within the chamber by engagement with a locking shoulder on one of the walls of the chamber. Upon insertion of a proper releasing tool into either face of the connector, the locking tab can be released from engagement with the locking shoulder to facilitate removal of the contact member from the insulating body. According to the invention, a releasing shoulder protrudes laterally from the locking tab so as to be positioned adjacent the locking shoulder when the contact member is locked in fixed position within the chamber. A first passageway leads from one face of the insulating body to the releasing shoulder for insertion of a releasing tool to engage and displace the releasing shoulder and thereby effect sufficient simultaneous movement of the locking tab to release the latter from locking engagement with the locking shoulder. A second pasageway leading from the other face of the insulation body permits the insertion of a releasing tool to engage and displace the locking tab directly in order to release the latter from locking engagement with the locking shoulder.

8 Claims, 5 Drawing Figures

ELECTRICAL CONNECTOR WITH RELEASABLE CONTACT MEMBERS

This is a continuation, of application Ser. No. 631,282, filed Nov. 12, 1975, now abandoned.

BACKGROUND OF THE INVENTION

1. Field of the Invention

The field of art to which the invention pertains includes the field of electrical plug-type connectors, and particularly, the field of connectors having insertable and releasable contact members within the chambers of an insulating body.

2. Description of the Prior Art

Plug-type connectors with releasable contact members are known in which the contact member is locked in fixed position within the insulating body, and the connector can thus be assembled more rapidly than connectors in which the contact member is joined with the insulating body by some other means, e.g., by screws. In addition, connectors of this type can be produced at relatively low cost. The contact members of such connectors may be in the form of jacks, plug sockets, pins, and any known form of male or female connector components.

In connectors of this type, the insulating body is frequently provided with a plurality of contact receiving chambers. An important problem presented to those skilled in the art concerns the removal of the contact member from the contact chamber once it has been inserted. In order to release the contact member, releasing tools inserted into the contact chamber are frequently employed. The tools lift a locking tab of the contact member from engagement with a corresponding locking shoulder on a wall of the contact chamber, so that the locking engagement is interrupted and the contact member can be removed. It is desirable, of course, that the release operation be rapidly and easily executed. Additionally, it is desirable that the releasing tool be as simple as possible.

One of the limitations of prior art connectors of this type has been that the contact member is releasable from the insulating body only with the aid of a releasing tool inserted from one side of the connector. Often, the releasing operation is effectuated from the termination side of the contact members which renders the operation difficult in view of the large number of wires leading to the termination points of the contact members. Additionally, there is often little free space behind a connector panel within which to manipulate a releasing tool, and thus it is required to often dismount a connector from the panel or remove the entire panel in order to have sufficient room to conduct the releasing operation.

SUMMARY OF THE INVENTION

The present invention provides a configuration of contact member and insulating body in which the locking engagement can be broken with the aid of a releasing tool from either side of the connector. That is, the tool may be inserted from the connecting side of the connector where a mating connector is attached or from the termination side of the connector where conductors terminate at the contact members.

A further object of the invention is to provide an improved plug-type connector of the above-mentioned type such that a contact member which is in a locked position within a contact chamber of an insulating body can be released from either side of the connector in a simplified manner.

In known connectors, a contact member can be released from a locked position in the contact chamber only from one side. The contact member is usually released by inserting an appropriately shaped releasing tool between the locking tab and the interior chamber wall close to the locking tab. The releasing tool is pushed in until the locking tab has been lifted from the locking shoulder in the chamber. Then the contact member can then be withdrawn from the contact chamber toward the side of the conductor terminations. To accommodate insertion of the tool, a passageway is normally provided between the locking tab and the adjacent interior wall of the chamber. However, since the locking tab abuts a locking shoulder within the chamber, the tab is not accessible to a releasing tool inserted from the opposite side of a connector, because the locking shoulder blocks the passage of the releasing tool.

According to the invention, the above objectives are met by providing an insulating body having opposite faces and at least one contact receiving chamber extending through the body and opening at each of the faces. The body includes, in each of its chambers, a locking shoulder on one wall of the chamber for locking a contact member in fixed position within the chamber. At least one contact member is disposed within each chamber with each contact member having a locking tab engaging the locking shoulder of the chamber to lock the contact member in the fixed position. In such position, the locking tab is releasable from engagement with the locking shoulder by insertion of a releasing tool to move the locking tab away from the locking shoulder. In order to facilitate release of the contact member from both faces of the insulating body, a releasing shoulder is provided on the locking tab and protrudes laterally of the locking tab so as to be positioned adjacent the locking shoulder of the chamber when the contact member is locked in fixed position within the chamber. A passageway leads from one of the faces to the releasing shoulder for insertion of a releasing tool to engage and displace the releasing shoulder and thereby effectuate efficient simultaneous movement of the locking tab to release the latter from locking engagement with the locking shoulder. The releasing shoulder includes a ramped extension at the point of engagement with the releasing tool to facilitate a more reliable releasing action. Release of the contact member from the other face of the insulating body is possible by inserting the releasing tool into a second passageway leading from the other face of the insulating body to engage and displace the locking tab directly to release the latter from locking engagement with the locking shoulder.

The releasing tab projecting laterally from the locking tab may be provided with a ramped extension to facilitate insertion of the releasing tool between the releasing tab and the adjacent wall of the contact receiving chamber.

In an alternate embodiment of the invention, there is provided one locking shoulder on each of two opposing facing walls of the contact receiving chamber. This configuration has the advantage that the contact member can be inserted into the contact receiving chamber in either of two positions which are 180° angularly displaced about the longitudinal axis of the contact member.

In a preferred embodiment, the locking shoulder for the locking tab has the form of a protrusion which extends only partially across a wall of the chamber in a direction perpendicular to the direction of contact member insertion. With this configuration, no special insertion channel for the releasing tool need be provided in the insulating body for the purpose of introducing the releasing tool between the locking tab and the adjacent wall of the chamber. The necessary channel is thus provided by the absence of a locking shoulder along a small portion of the chamber wall.

A ramp is preferably provided on one edge of the locking shoulder on the side from which the contact member is inserted into the chamber. The purpose of the ramp is to allow smooth insertion of the contact member into the chamber and effect a snap action of the locking tab against the locking shoulder after the tab has been elevated by the ramped edge. To allow for the snap action of the locking tab, the locking shoulder has an edge perpendicular to and facing away from the direction the contact member is inserted into the chamber.

A flat raised portion on the wall of the chamber containing the locking shoulder may be provided to engage a portion of the contact member and limit the movement of the contact member toward the chamber wall thereby to leave a space between the chamber wall and the contact member defining the above-mentioned second passageway for the releasing tool.

BRIEF DESCRIPTION OF THE DRAWINGS

The invention will now be described in detail with reference to the accompanying drawings representing preferred embodiments of the electrical connector according to the present invention. In the drawings.

DESCRIPTION OF THE PREFERRED EMBODIMENT

Figure 1:
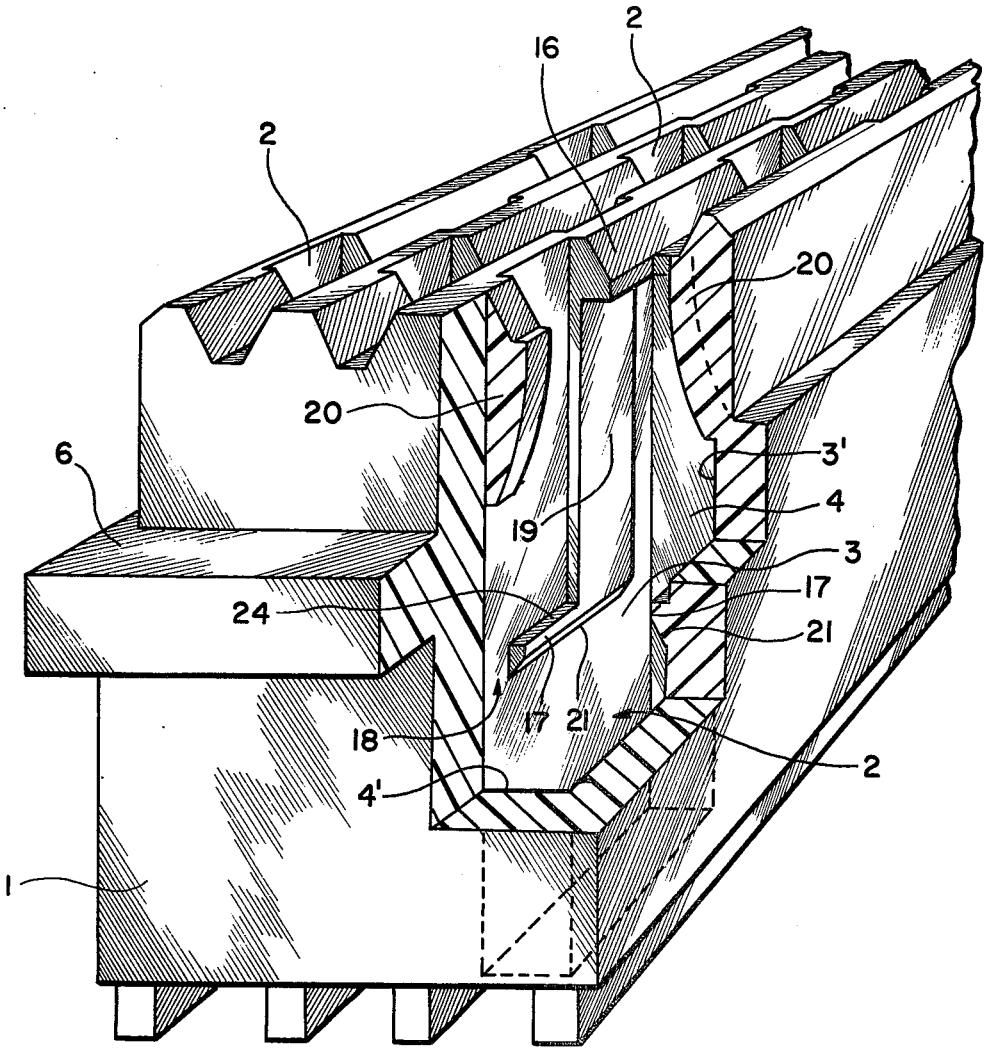
FIG. 1 is a partial cross-sectional view of an insulating body for the connector according to the invention.
Figure 2:
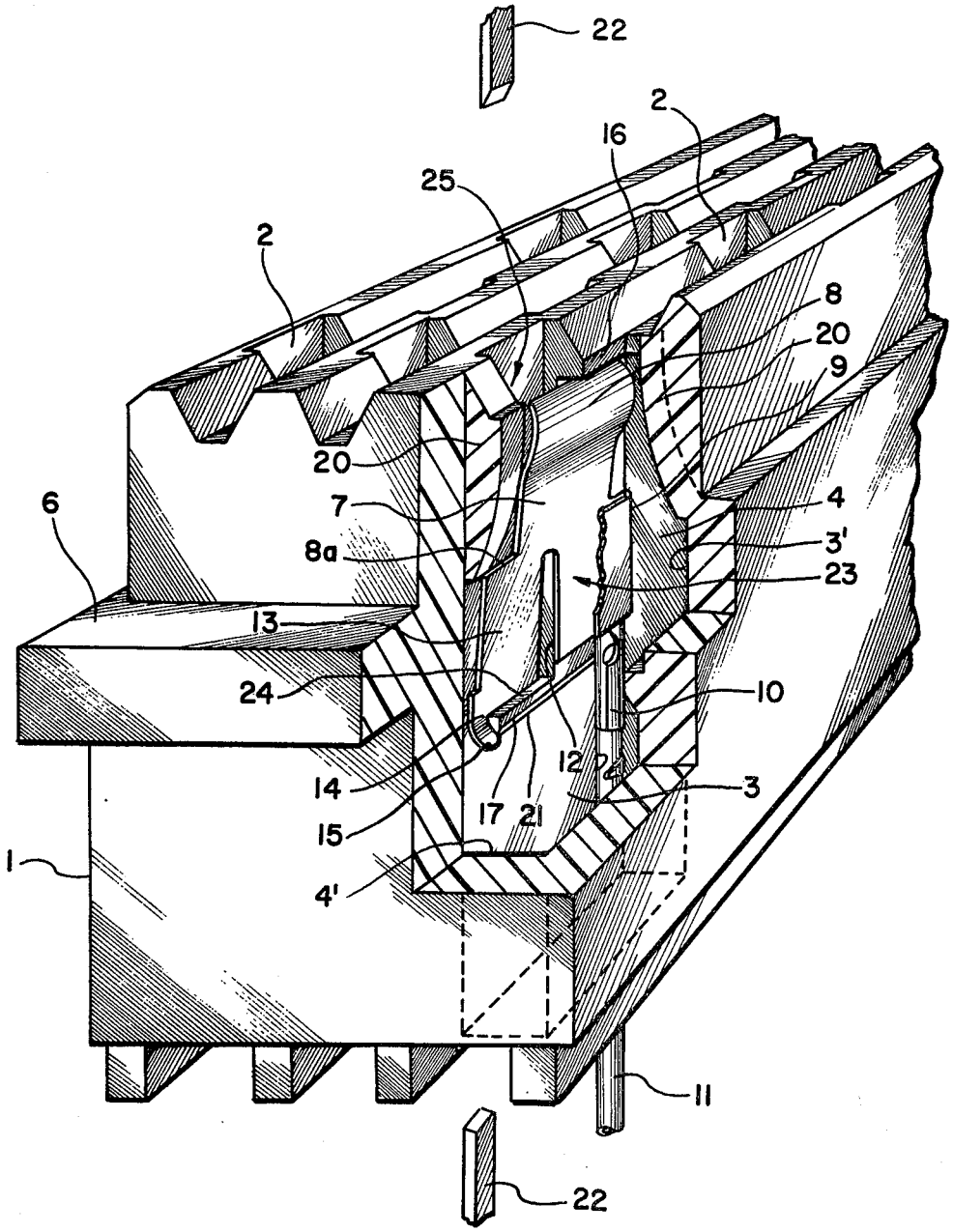
FIG. 2 shows the insulating body of FIG. 1 with a contact member inserted into one of the contact chambers.

The insulating body 1 shown in FIGS. 1 and 2 forms part of a spring-type contact connector according to DIN (German Industrial Standards) 41,612 Series II. However, the subject invention is not to be restricted to contact connectors of this type but may be used with connector insulating bodies of any type, including those having a single contact chamber.

Insulating body 1 shown in FIGS. 1 and 2 is provided with three rows of contact chambers 2, one of which is partially cut away to expose the essential components along the interior walls of the chamber. The individual contact chambers 2 are formed by and individually separated by mutually perpendicular chamber walls 3 and 4. Walls 3' and 4' are opposite walls 3 and 4, respectively, to form the chamber 2. A mounting flange 6 is provided on each side face of the insulating body 1.

Figures 3, 4, 5:
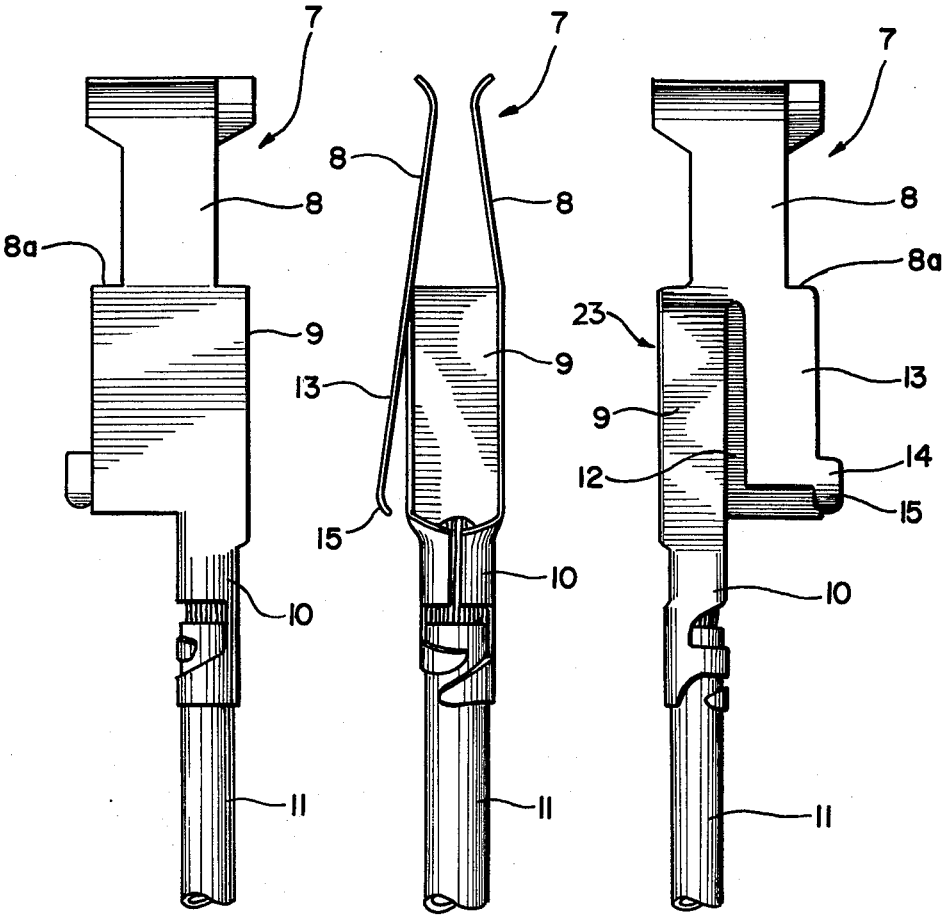
FIG. 3 is a front view of a contact member according to the subject invention.
FIG. 4 is a side view of the contact member of FIG. 3.
FIG. 5 is a rear view of the contact member of FIG. 3.

In FIG. 2, a contact member 7 of the type shown in the FIGS. 3–5 can be inserted into contact receiving chamber 2. The contact member shown has the form of a female connector receptacle. However, the invention is not to be restricted to a receptacle-type connector component, but can accommodate any connector component, male or female.

With reference to FIGS. 2–5, it will be seen that contact member 7 may be formed from a single piece of sheet metal and, at the connector side, is provided with two oppositely disposed resilient contact arms 8, between which an appropriately shaped blade-type (male) contact member can be inserted.

Contact arms 8 are joined by a lateral bridge 9. Above the bridge 9, the two contact arms 8 are bent to approach each other toward the entry side of the male connector. At the upper end of the contact member, the contact arms 8 are outwardly bent to facilitate the entry of a male blade-type connector.

Bridge 9 ends in a cable termination section 10 which is adapted to receive an electrical conductor 11 on the terminal side of the contact. In the embodiment shown, termination section 10 is a squeeze-type terminal.

In the area of bridge 9, the contact member 7 has a flat portion consisting of a main contact portion 23 and a locking tab 13 separated by a slot 12 extending longitudinally of said contact member 7 and partially into the area of the main contact portion 23 and locking tab 13. Locking tab 13 is bent slightly outwardly, away from the longitudinal axis of contact member 7. On the termination end of locking tab 13, there is provided a releasing shoulder 14 which laterally protrudes from the edge of the locking tab 13 and which has an inwardly bent extension 15 serving as a ramp on the termination side of the contact member.

Contact receiving chamber 2 has a substantially rectangular cross-section and on the connecting side of the connector, is provided with an edge 16 which limits the upward movement of contact member 7. The opening which is formed in chamber 2 on the connecting side of the plug is dimensioned so that a mating blade-type connector (not shown) can be inserted between contact arms 8 of contact member 7, and when the mating connector is removed, a releasing tool (described below) can be introduced between locking tab 13 of contact member 7 and wall 3 of chamber 2 adjacent locking tab 13.

A locking shoulder 17 is provided on wall 3 of each chamber 2 for locking a contact member in fixed position within the chamber.

Locking shoulder 17 is in the form of a protrusion extending along inner wall 3 of chamber 2 in a direction perpendicular to the direction the contact member is inserted into the chamber. As shown in FIG. 2, locking shoulder 17 is arranged substantially in the middle between the terminal side and the connecting side of contact chamber 2 on two facing walls 3, 3' thereof. Locking shoulder 17 occupies about one-third of the width of the contact chamber 2. As seen in FIGS. 1 and 2, between the left edge of locking shoulder 17 and the adjacent wall 4' of chamber 2, there is provided a gap or passageway 18 which serves to receive releasing shoulder 14 of locking tab 13. FIG. 2 shows the contact member 7 in fixed position with locking tab 13 lockingly engaged with an abutting perpendicular face 24 of locking shoulder 17, while releasing shoulder 14 with its extension 15 is unobstructed by the perpendicular face 24.

On the side of wall 3 opposite passageway 18, the locking shoulder 17 extends in the form of a flat raised portion 19 which extends to the upper edge 16 on the connecting side of chamber 2. A stop 20, whose function will be described below, is provided on the wall 3 of contact chamber 2. Edge 21 is provided on the terminal side of locking shoulder 17 and extends across the bottom of flat raised portion 19. Edge 21 is bevelled to facilitate insertion of contact member 7 into chamber 2.

As viewed in FIG. 2, contact member 7 was inserted into chamber 2 from the side of the cable terminations. Upon insertion, locking tab 13 slides over locking shoulder 17 and becomes locked into its fixed position behind perpendicular face 24 of locking shoulder 17. In this position, releasing shoulder 14 is situated in passageway 18 between locking shoulder 17 and the adjacent chamber wall 4'.

The upper end edges of contact arms 8 remote from the locking tab side of the contact member bear against the flat raised portions 19 directly beneath edge 16. Movement of contact member 7 is limited in downward movement, as shown in FIG. 2, by the perpendicular face 24 of locking shoulder 17 and in the other direction by edge 16 and b stop 20 which is engaged by lateral stop faces 8*a* provided on contact member 7 (reference FIGS. 3–5). Stop faces 8*a* cooperate with stop 20 in contact receiving chamber 2 and insure that contact member 7 cannot, for all practical purposes, be tilted from its central position, so that an insertable-type mating connector contact member securely enters between the two contact arms 8. In the embodiment of contact member 7 shown in FIG. 3, the forwardmost contact arm 8 which is not provided with a slot 12 bears against the flat raised portion 19 on wall 3' and therefore is not placed in a locked position behind locking shoulder 17.

When a locking shoulder 17 is provided on each of the two facing chamber walls 3 and 3', contact member 7 can be inserted into chamber 2 in the position shown in the drawing and, in addition, in a position angularly displaced by 180° about the longitudinal axis of contact member 7. Moreover, it is possible to provide both contact arms 8 with locking tabs 13, releasing shoulders 14, and extensions 15 so that contact member 7 can enter into a locked in position in which one locking tab engages each of the locking shoulders of the chamber walls 3, 3' for improved securement of the contact member in the chamber.

Contact member 7 can be released from the locked in position in chamber 2 with the aid of a releasing tool which can be inserted from either side of the insulating body. The releasing tool can be formed, as shown in FIG. 2, by a metal pin 22 with a bevelled tip. In order to release contact member 7 from the connecting side of the insulating body 1, metal pin 22 is inserted between locking tab 13 and the adjacent wall 3 of chamber 2. Since the adjacent contact arm 8 bears against flat raised portion 19, a passageway 25 exists between contact arm 8 and chamber wall 3 so that metal pin 22 can be easily inserted. By inserting metal pin 22, the locking tab 13 is lifted from locking engagement with shoulder 17 so that contact member 7 can be removed from chamber 2 by withdrawing conductor 11.

In order to release the contact member 7 from the terminal side of the insulating body 1, metal pin 22 is inserted from that side into contact chamber 2 through passageway 18 and pushed under releasing shoulder 14. Further movement lifts releasing shoulder 14, and locking tab 13 is simultaneously released from engagement with locking shoulder 17, which makes it possible to pull contact member 7 from chamber 2 by withdrawing conductor 11, as described above.

The width of metal pin 22 must be such that the metal pin can be introduced into the gap 18 between locking shoulder 17 and the adjacent chamber wall 4'. The thickness of the metal pin 22 must be dimensioned to be smaller than the height of flat raised portion 19 in order to fit between wall 3 and contact arm 8 resting against flat raised portion 19.

In the event that a contact member 7 is provided with two locking tabs 13, as discussed above, a fork-shaped releasing tool is conveniently employed, the pins of which simultaneously engage both locking tabs 13 and/or both releasing shoulders 14 to effect removal of contact member 7.

From the foregoing it can be readily realized that this invention can assume various embodiments. Thus, it is to be understood that the invention is not limited to the specific embodiments described herein, but is to be limited only by the appended claims.

The embodiments of the invention in which an exclusive property or privilege is claimed are defined as follows:

1. An electrical connector comprising:

an insulating body having opposite termination and mating contact faces and at least one contact receiving chamber extending through said body and opening at each of said faces, said termination face adapted to receive wires for connection to connector contact members;

said body including, in each chamber, a locking shoulder on one wall of said chamber and positioned to lock a contact member within the chamber and prevent removal through the opening in the termination face; and at least one contact member disposed within each chamber, each said contact member including a locking tab engaging said locking shoulder to lock said contact member in a fixed position, said locking tab being releasable from engagement with said locking shoulder by the insertion of a releasing tool to move said locking tab away from said locking shoulder and permit removal of the contact through the opening at said termination face, the improvement comprising:

a releasing shoulder means for the outward release of the contact member through the termination face protruding laterally of said locking tab so as to be positioned laterally adjacent said locking shoulder when said contact member is locked in said fixed position;

means defining a first passageway leading from said termination face to said releasing shoulder means for insertion of a releasing tool to engage and displace said releasing shoulder means and thereby effectuate sufficient concurrent movement of said locking tab to release the latter from locking engagement with said locking shoulder and permit removal of the contact through the opening at said termination face without insertion of a releasing tool from said mating contact face; and a second passageway leading from the mating contact face for insertion of a releasing tool to engage and displace said locking tab to release the latter from locking engagement with said locking shoulder.

2. The improved connector as claimed in claim 1, wherein said releasing shoulder means includes a ramped extension at the point of engagement with an inserted releasing tool.

3. The improved connector as claimed in claim 1, wherein:

each of said chambers includes two of said locking shoulders, one on each of two opposed walls of said chamber.

4. The improved connector as claimed in claim 1, wherein said locking shoulder is in the form of a protrusion extending along an inner wall of said chamber in a direction perpendicular to the direction said contact member is inserted into said chamber.

5. The improved connector as claimed in claim 4, wherein said locking shoulder has a ramped edge on the side from which said contact member is inserted into said chamber.

6. The improved connector as claimed in claim 5, wherein said locking shoulder has an edge perpendicular to and faces away from the direction said contact member is inserted into said chamber.

7. An electrical connector comprising:

an insulating body having opposite termination and mating contact faces and at least one contact receiving chamber extending through said body and opening at each of said faces;

said body including, in each chamber, a locking shoulder on one wall of said chamber and positioned to lock a contact member within the chamber and prevent removal through the opening in the termination face;

at least one contact member disposed within each chamber, each said contact member including a locking tab engaging said locking shoulder to lock said contact member in a fixed position, said locking tab being releasable from engagement with said locking shoulder by the insertion of a releasing tool to move said locking tab away from said locking shoulder and permit removal of the contact through the opening at said termination face, the improvement comprising:

a releasing shoulder protruding laterally of said locking tab so as to be positioned laterally adjacent said locking shoulder when said contact member is locked in said fixed position;

means defining a first passageway leading from said termination face to said releasing shoulder for insertion of a releasing tool to engage and displace said releasing shoulder and thereby effectuate sufficient concurrent movement of said locking tab to release the latter from locking engagement with said locking shoulder and permit removal of the contact through the opening at said termination face without insertion of a releasing tool from said mating contact face;

a second passageway leading from the mating contact face for insertion of a releasing tool to engage and displace said locking tab to release the latter from locking engagement with said locking shoulder;

said contact member having a flat portion facing said one wall of said chamber, said flat portion having a slot extending longitudinally of said contact member and partially into said flat portion to separate said contact member into a first main contact portion and a second portion containing said locking tab and releasing shoulder; and said one wall of said chamber has a flat raised portion laterally displaced in said chamber from said locking shoulder;

said contact member being bent slightly to bias said locking tab out of the plane of said main contact portion, to thereby permit firm engagement of said locking tab with said locking shoulder and surface-to-surface contact between said flat raised portion of said chamber and said main contact portion of said contact member.

8. The improved connector as claimed in claim 7, wherein the height of said flat raised portion determines the spacing between said one wall and said contact member, and thereby fixes the maximum width of the releasing tool.

* * * * *